US005104082A

United States Patent [19]

Bayer

[11] Patent Number: 5,104,082

[45] Date of Patent: Apr. 14, 1992

[54] HOOK FOR CHANDELIER ORNAMENTS

[75] Inventor: Georg Bayer, Plattsburgh, N.Y.

[73] Assignee: A. Schonbek & Co., Inc.

[21] Appl. No.: 539,802

[22] Filed: Jun. 18, 1990

[51] Int. Cl.[5] ..... A47H 1/16

[52] U.S. Cl. ..... 248/303; 248/339

[58] Field of Search ..... 248/303, 304, 305, 339, 248/340, 341, 690, 211, 213, 215, 227, 290, 294, 306, 307, 308, 322, 341; 24/598.6, 370

[56] References Cited

U.S. PATENT DOCUMENTS

| | | | |
|---|---|---|---|
| 1,601,652 | 9/1926 | Sohnle | 248/211 |
| 1,927,315 | 9/1933 | Kamp | 248/211 |
| 2,848,600 | 8/1958 | Roth | 248/303 X |
| 3,240,463 | 3/1966 | Cook | 248/303 X |
| 3,272,467 | 9/1966 | Kassube | 248/303 X |
| 4,714,166 | 12/1987 | Hann et al. | 248/304 X |

*Primary Examiner*—Ramon O. Ramirez
*Attorney, Agent, or Firm*—Wolf, Greenfield & Sacks

[57] ABSTRACT

A novel chandelier hook for a chandelier trimming is provided. The hook has a pair of bends, one of which is adapted for engagement with an opening in a chandelier frame, and the other of which is adapted to resist accidental displacement of the trimming from the chandelier frame.

11 Claims, 2 Drawing Sheets

HOOK FOR CHANDELIER ORNAMENTS

FIELD OF THE INVENTION

This invention relates generally to a hook for hanging chandelier ornaments, and more particularly to an improved hook for securing a chandelier ornament against dislodgment from a chandelier frame.

BACKGROUND OF THE INVENTION

Typical prior art hooks for hanging chandelier ornaments are shown in FIG. 1. The hook 10 is an elongated member having a first end 12 for engaging a chandelier frame 14 and a second end 16 for engaging a chandelier ornament such as a crystal ornament 18. The first end 12 is bent at an acute angle to form a substantially V shaped segment for interengagement with the frame 14. The V shape is formed from an upper portion of an elongated segment 20, a bend 22 and a distal arm 24. Although such hooks are simple to manufacture and are adequate for hanging an ornament on a frame, they do not prevent against upward displacement of the hook from the frame and unintentional disengagement.

SUMMARY OF THE INVENTION

The invention provides a chandelier trimming including a hook for hanging a chandelier ornament that is easy to manufacture and install, but at the same time is secured from accidental dislodgment. The hook may be configured such that it is concealed from view, thereby contributing to the overall ornamental design of the chandelier, and at the same time such that it is capable of being used with a wide variety of conventionally available frames.

According to the invention, the improved chandelier trimming includes a chandelier ornament and a hook for supporting the ornament on a chandelier frame. The hook includes an elongated member having a first end for engaging the frame and a second end for engaging the ornament. The first end includes an elongated segment, a middle arm and a distal arm. The middle arm is connected to the elongated segment by a first bend and is oriented with respect to the elongated segment at an acute angle. The distal arm is connected to the middle arm by a second bend and the distal arm is oriented at an angle with respect to the elongated segment of at least 90 degrees. One or both of the bends may be substantially U-shaped. Axial movement of the elongated member in the direction of the frame causes the distal arm or second bend to engage the frame and resist dislodgment of the hook from the frame.

Various configurations of the hook are desirable. For example, the elongated segment, middle arm and distal arm may be substantially coplanar. The hook also may be formed such that the distal arm is not substantially coplanar with the middle arm and elongated segment. In one preferred embodiment, the distal arm extends substantially perpendicular to a plane formed by the middle arm and elongated segment. In another preferred embodiment, the distal arm and middle arm form a helix. According to any of the embodiments, the distal arm is formed in such a way that axial movement of the elongated member upwardly toward the frame causes the distal arm or second bend to be forced against the frame in a manner to resist displacement of the hook from the frame.

BRIEF DESCRIPTION OF THE DRAWINGS

The foregoing objects and advantages of the present invention will be more clearly understood in connection with the accompanying drawings in which.

DETAILED DESCRIPTION OF THE PREFERRED EMBODIMENTS

Figure 2:
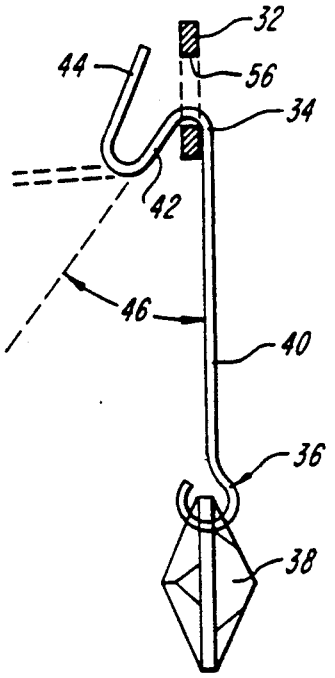
FIG. 2 is a side view of an embodiment of the invention shown installed in a frame.

Referring to FIG. 2, a chandelier trimming 30 is shown attached to a chandelier frame 32. The chandelier trimming includes an elongated member having a first end 34 for engaging the chandelier frame 32 and a second end 36 attached to a crystal ornament 38. The two ends 34, 36 are separated by an elongated segment 40, which elongated segment forms the main portion of the elongated member. The first end 34 of the elongated member has two bends, thereby forming a middle arm 42 and a distal arm 44. The middle arm 42 extends from the elongated segment 40 and forms with the elongated segment 40 a first angle 46. The first angle 46 is acute, which herein is intended to include angles of less than 90 degrees, including those formed by U-shaped bends. The distal arm 44 extends from the middle arm 42 upwardly with respect to the middle arm 42.

Figure 3:
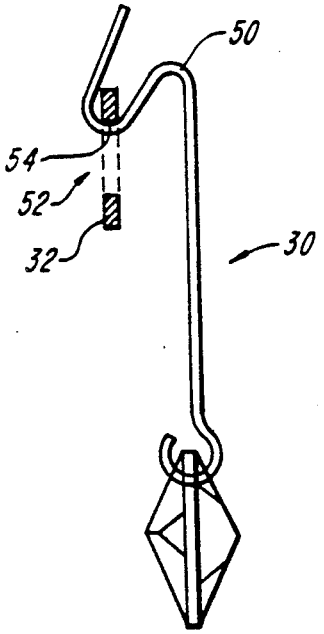
FIG. 3 is a side view of the embodiment of FIG. 2 shown when an axially upward force applied to the chandelier trimming.

FIG. 3 illustrates how the hook of the invention resists displacement from the chandelier frame when the chandelier trimming is moved axially upwardly. When such a force is applied, the first bend 50 is moved from its hanging position within the opening 52 of the chandelier frame 32. However, the second bend 54 then engages the upper surface 56 of the opening 52 to prevent further dislodgment of the chandelier trimming 30 from the chandelier frame 32. As will be understood by one of ordinary skill in the art, the chandelier trimming 30 of course may be removed from the opening by a "snaking" motion. The trimming, however, resists displacement when a substantially axial force is applied.

Figure 1:
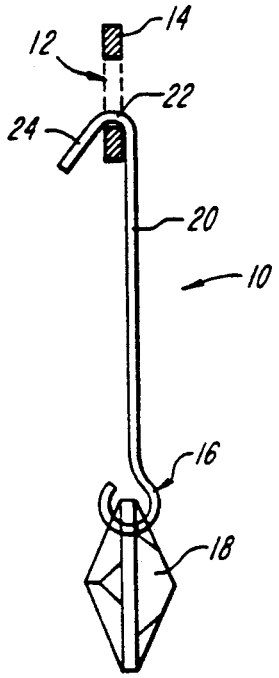
FIG. 1 is a side view of a prior art device shown inserted in a frame.

In the chandelier trimming shown in FIG. 2, the elongated segment 40, middle arm 42 and distal arm 44 lie substantially in the same plane. This need not be the case as will be evident from the embodiments described below. The distal arm 44 of FIG. 2 also is shown as extending upwardly with respect to the middle arm. This also is not essential. Rather, the distal arm 44 must be oriented at least 90 degrees to the elongated segment (shown in phantom in FIG. 1). Many orientations extending upwardly of the phantom orientation are possible. It is important only that there is a first bend for hanging the trimming on a chandelier frame and a second bend resulting in a segment adapted for interengagement with the frame to resist dislodgment of the trimming from the chandelier frame when an axial force is applied.

Figure 4:
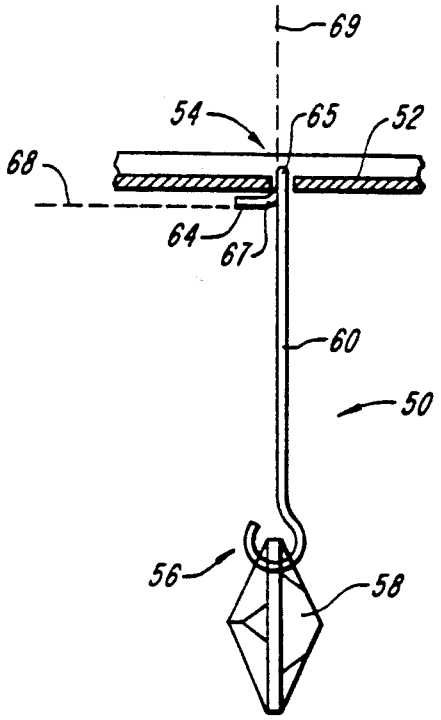
FIG. 4 is a perspective view of a second embodiment of the invention shown installed in a frame.

FIG. 4 illustrates another embodiment of the invention. In this embodiment, the chandelier trimming 50 is attached to a chandelier frame 52. The chandelier trimming includes an elongated member having a first end 54 for attachment to the chandelier frame and a second end 56 for attachment to a crystal ornament 58. Like the embodiment of FIG. 2, the elongated member includes an elongated segment 60, a middle arm (not shown) and a distal arm 64. Like the embodiment of FIG. 2, the middle arm 62 extends at a first bend 65 from the elongated segment 60 and forms with the elongated segment 60 a first angle. The first angle is acute. The distal arm 64 extends from the middle arm at a second bend 67. The distal arm 64 defines an axis (dotted line 68) that is substantially perpendicular to the axis (dotted line 69) defined by the elongated segment 60. A main difference between the embodiment of FIG. 4 and that of FIG. 2 is that the distal arm 64 is not coplanar with the plane defined by the middle arm and elongated segment 60. Instead, the distal arm 64 is oriented substantially perpendicularly to the plane defined by the middle arm and elongated segment 60. This embodiment is particularly useful with frames oriented on the flat as shown in FIG. 4.

Figure 5:
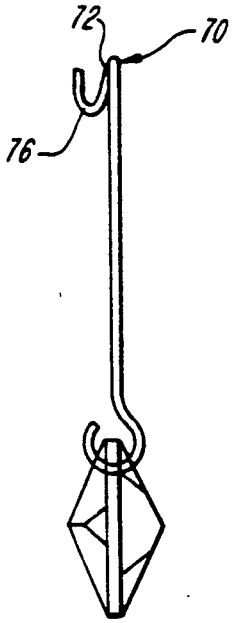
FIG. 5 is a perspective view of a third embodiment of the invention.

FIG. 5 illustrates yet another embodiment of a chandelier trimming according to the invention. This embodiment differs in that the frame engaging end 70 of the chandelier trimming is bent into the form of a helix. The trimming still has two bends, a first bend 72 defining a segment for hanging engagement with a chandelier frame 74 and a second bend 76 defining a segment for resisting displacement of the chandelier trimming from the frame when the trimming is moved axially upwardly.

The foregoing detailed description is meant to be illustrative, and not limiting. It will be understood by those of ordinary skill in the art that bends of various shapes are possible according to the invention. The two bends may be substantially coplanar or may define planes oriented at angles to one another. The bends may form sharp transitions or may be gently curving segments and, as in the case of a helical bend, the two bends may be substantially continuous. Thus various modifications and equivalents to the foregoing preferred embodiments will be apparent to those of ordinary skill in the art.

What is claimed is:

1. A chandelier trimming comprising:

an ornament, and an elongated member having a fist end for engaging the ornament and a second end for engaging a chandelier frame, wherein the second end includes a first bent segment for engaging the chandelier frame when the chandelier trimming is hung from the frame and a second segment located distally of the first bent segment for resisting substantially vertical upward displacement of the chandelier trimming from the chandelier frame.

2. A chandelier trimming as claimed in claim 1 wherein the elongated member includes an elongated segment, a middle arm and a distal arm, and wherein the distal arm is said second segment configured to resist displacement of the chandelier trimming from the chandelier frame.

3. A chandelier trimming as claimed in claim 2 wherein the middle arm and the elongated segment are joined by the first bent segment and wherein the middle arm forms an acute angle with the elongated segment.

4. A chandelier trimming as claimed in claim 1 wherein the second segment includes a second bent segment and wherein the first and second bent segments are substantially U-shaped.

5. A chandelier trimming as claimed in claim 1 wherein the second end forms a helix.

6. A chandelier trimming as claimed in claim 2 wherein the first bend segments forms a first plane and wherein the distal arm extends outwardly of the first plane.

7. A chandelier comprising;

a chandelier frame, a surface defining an opening in the frame, and a chandelier hook supporting an ornament on the chandelier frame, the hook including an elongated member having a first end, the first end including means for engaging the surface defining the opening in the frame when the hook is positioned through the opening to hand the ornament from the frame, and the first end further including means for retaining the hook in the opening, the retaining means constructed and arranged to resist substantially vertical upward displacement of the hook from the opening when the hook is positioned through the opening to hang the ornament from the frame.

8. A chandelier according to claim 7, characterized in that the means for engaging a surface is a U-shaped bend.

9. A chandelier according to claim 7, characterized in that the means for retaining the hook includes a U-shaped bend.

10. A chandelier according to claim 7, characterized in that the means for retaining the hook is substantially helical.

11. An hook device for hanging an ornament on a chandelier comprising:

an elongated member having a first end for engaging a frame and a second end for engaging an ornament;

wherein said first end comprises a middle arm extending from an elongated segment at a first acute angle, and a distal arm extending from said middle arm so as to form a substantially U shaped bend, and wherein said distal arm is oriented at an angle to a first plane, defined by said elongated segment and said middle arm.

* * * * *